US009476595B2

(12) United States Patent
Cadima

(10) Patent No.: US 9,476,595 B2
(45) Date of Patent: Oct. 25, 2016

(54) AUTO FLAME-OUT DETECTION AND REIGNITION METHOD FOR A GAS BURNER OF A COOKTOP APPLIANCE

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 482 days.

(21) Appl. No.: 14/098,753

(22) Filed: Dec. 6, 2013

(65) Prior Publication Data

US 2015/0159881 A1 Jun. 11, 2015

(51) Int. Cl.
*F24C 3/12* (2006.01)

(52) U.S. Cl.
CPC ..... *F24C 3/126* (2013.01); *F23N 2027/00* (2013.01); *F23N 2041/08* (2013.01)

(58) Field of Classification Search
CPC ..... F24C 3/126
See application file for complete search history.

(56) References Cited

U.S. PATENT DOCUMENTS

| | | | | |
|---|---|---|---|---|
| 4,168,947 | A | 9/1979 | Matthews | |
| 5,403,183 | A * | 4/1995 | Andersson | F23D 14/725 431/27 |
| 5,961,311 | A | 10/1999 | Moore, Jr. | |
| 6,729,873 | B2 | 5/2004 | Neufield et al. | |
| 2011/0086319 | A1* | 4/2011 | Chodacki | F23N 5/242 431/74 |
| 2012/0052454 | A1* | 3/2012 | Roy | F23D 23/00 431/74 |

* cited by examiner

*Primary Examiner* — Steven B McAllister
*Assistant Examiner* — Rabeeul Zuberi
(74) *Attorney, Agent, or Firm* — Dority & Manning, P.A.

(57) ABSTRACT

A system is provided to automatically detect and reignite one or more gas burners on a cooktop appliance. Upon determining the absence of a flame at a gas burner, a time period $\Delta t_d$ is allowed to elapse during which no flame is detected before sparking is initiated to relight the burner. The value of $\Delta t_d$ is based upon the rate of flow of gaseous fuel to the burner with longer time periods being used for lower gas flow rates and shorter time periods being used for higher gas flow rates.

16 Claims, 3 Drawing Sheets

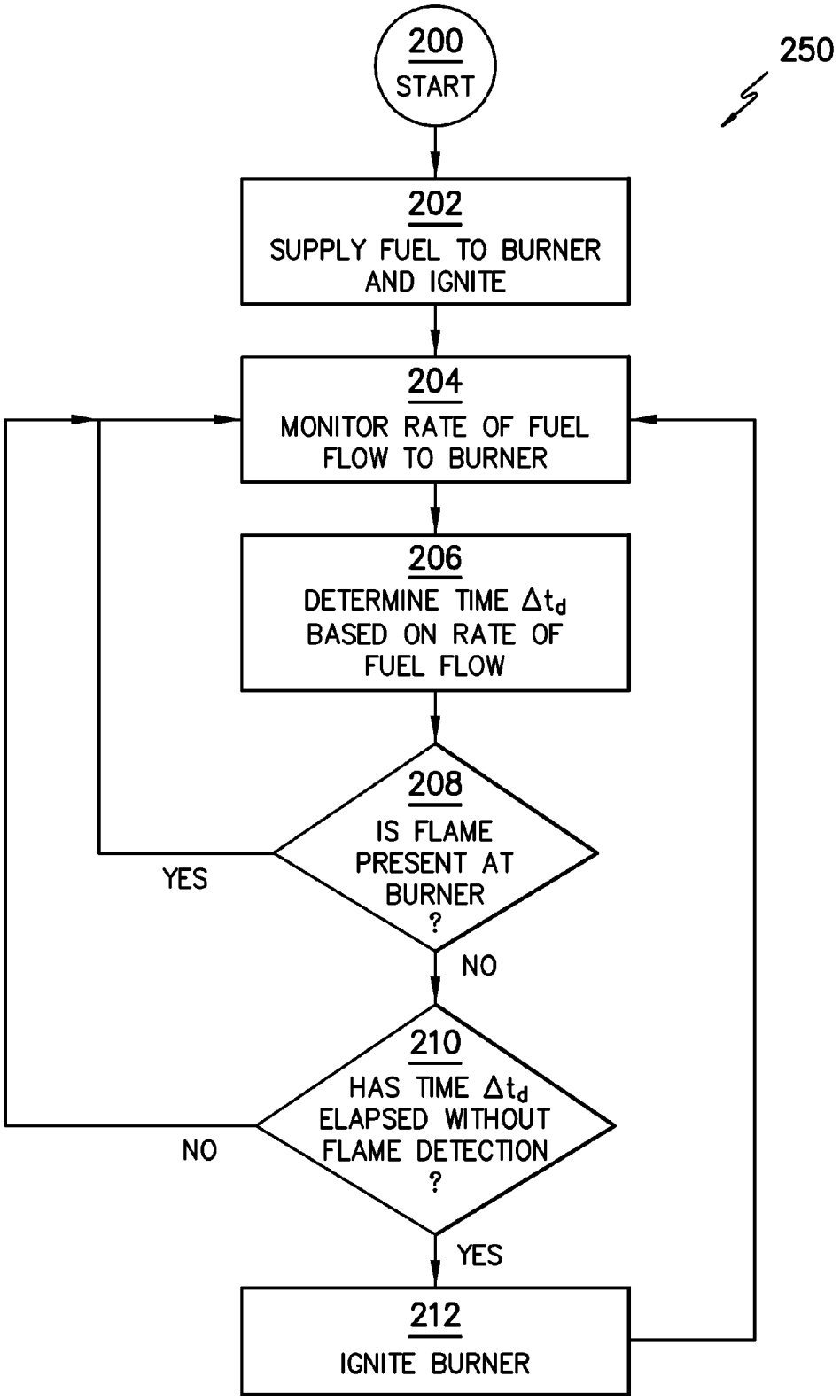
FIG. —3—

AUTO FLAME-OUT DETECTION AND REIGNITION METHOD FOR A GAS BURNER OF A COOKTOP APPLIANCE

FIELD OF THE INVENTION

The subject matter of the present disclosure relates generally to re-ignition of a gas burner on a cooktop of an appliance.

BACKGROUND OF THE INVENTION

Appliances having a cooktop can include one or more gaseous fuel burner assemblies for heating and cooking of food items. The burner assembly will ignite a gaseous fuel, such as propane or natural gas, to produce heat. A cooking utensil, such as a pot or pan containing, for example, a food item, is placed on the burner for heating. Different sizes and shapes can be provided for aesthetics and to accommodate different utensil sizes.

Conventionally, the flow of gas to each burner is controlled by a valve that can be manipulated by the user. With fuel flowing to the burner, an ignition system provides a spark that ignites the fuel. The valve can be adjusted to determine the level of gas flow to the burner and, therefore, the amount of heat output from the burner.

The ignition system is typically configured to automatically attempt to reignite the burner when a flame is no longer present. More specifically, upon the absence of flame, the igniter begins generating sparks and continues until the gaseous fuel is reignited. Such sparking usually generates a noise that can be perceived by the user.

When the valve is adjusted to set the burner at a low heat setting, the flame is subject to wafting, some of which is normally present in a low flame and some of which is created by local air currents. In either case, the absence of the flame, even if temporary and/or only partially around the body of the burner, automatically causes the ignition system to attempt a relighting of the burner even though the flame is not completely extinguished. Frequently, such attempted relighting is unnecessary because the flame will eventually fully restore itself around the body of the burner. The noise from the sparking during such attempted relighting can be a nuisance to the user—potentially causing dissatisfaction with the appliance and/or concern as to whether it is operating properly.

Accordingly, an ignition system that can automatically reignite a gas burner on the cooktop of an appliance while minimizing or eliminating nuisance sparking would be useful.

BRIEF DESCRIPTION OF THE INVENTION

The present provides a system to automatically detect and reignite one or more gas burners on a cooktop appliance. Upon determining the absence of a flame at a gas burner, a time period $\Delta t_d$ is allowed to elapse during which no flame is detected before sparking is initiated to relight the burner. The value of $\Delta t_d$ is based upon the rate of flow of gaseous fuel to the burner with longer time periods being used for lower gas flow rates and shorter time periods being used for higher gas flow rates. Additional aspects and advantages of the invention will be set forth in part in the following description, or may be apparent from the description, or may be learned through practice of the invention.

In one exemplary aspect, the present invention provides a method for operating a burner assembly of a cooktop appliance. The method includes the steps of supplying gaseous fuel to a burner of the burner assembly; monitoring the rate of flow of gaseous fuel to the burner; determining a time period $\Delta t_d$ that is based upon the rate of flow of gaseous fuel to the burner; detecting whether a flame is present at the burner and, if not, then activating a spark igniter for the burner after a time period $\Delta t_d$ has elapsed during which no flame is detected at the burner.

In another exemplary embodiment, the present invention provides an appliance with a cooktop. The appliance comprises a gas burner positioned on the cooktop and a valve controlling a flow of gaseous fuel to the gas burner. A sensor is configured to measure and signal the rate of flow of gaseous fuel to the gas burner. A spark igniter is positioned near the gas burner and is configured for igniting the gaseous fuel. A controller is configured to monitor signals from the sensor indicating the rate of flow of gaseous fuel, calculate a time period $\Delta t_d$ based on the rate of flow of gaseous fuel to the burner, detect whether a flame is present at the burner and, if not, then activate the spark igniter after a time period $\Delta t_d$ has elapsed during which no flame is detected at the burner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 is a schematic illustration or flow chart of an exemplary method of the present invention.

DETAILED DESCRIPTION OF THE INVENTION

Figure 1:
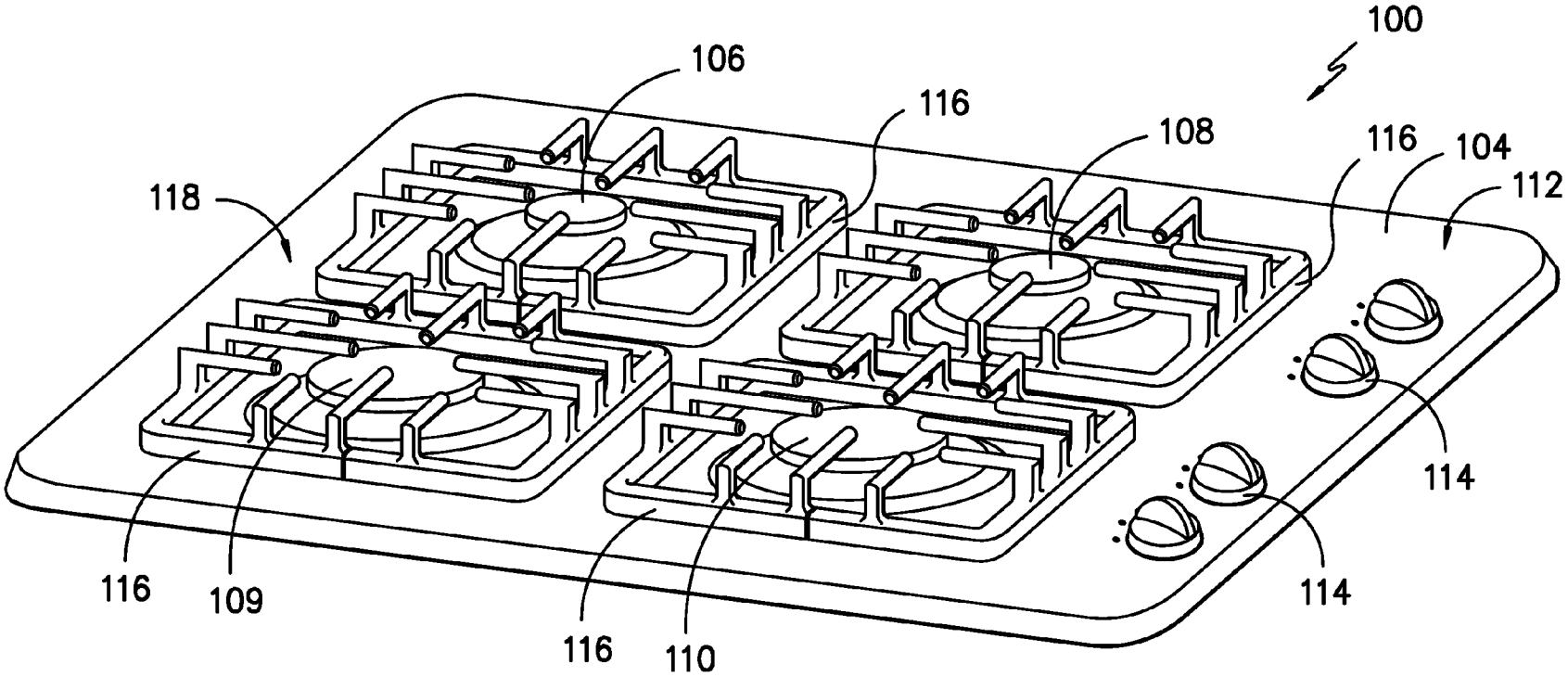
FIG. 1 provides an exemplary embodiment of a cooktop appliance as may be used with the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a top panel 104. By way of example, top panel 104 may be constructed of glass, ceramics, enameled steel, and combinations thereof.

For cooktop appliance 100, a utensil holding food and/or cooking liquids (e.g., oil, water, etc.) may be placed onto grates 116 at a location of any of burner assemblies 106, 108, 109, and 110. As shown in FIG. 1, burners assemblies 106, 108, 109, and 110 can be configured in various sizes so as to provide e.g., for the receipt of cooking utensils (i.e., pots, pans, etc.) of various sizes and configurations and to provide different heat inputs for such cooking utensils. Grates 116 are supported on a top surface 118 of top panel 104.

Burner assemblies 106, 108, 109, and 110 provide thermal energy to cooking utensils on grates 116. In particular, burner assemblies 106, 108, 109, and 110 extend through top panel 104 below grates 116. Burner assemblies 106, 108, 109, and 110 are also mounted to top panel 104. Burner assemblies 106, 108, 109, 110 provide for combustion of a gaseous fuel to provide heat energy for cooking.

A user interface panel 112 is located within convenient reach of a user of the cooktop appliance 100. For this exemplary embodiment, panel 112 includes knobs 114 that are each associated with one of burner assemblies 106, 108, 109, and 110. Knobs 114 allow the user to activate each burner assembly and determine the amount of heat input provided by each burner assembly 106, 108, 109, and 110 to a cooking utensil located thereon. Panel 112 may also be provided with one or more graphical display devices that deliver certain information to the user such as e.g., whether a particular burner assembly is activated and/or the level at which the burner assembly is set.

Although shown with knobs 114, it should be understood that knobs 114 and the configuration of cooktop appliance 100 shown in FIG. 1 is provided by way of example only. More specifically, user interface 112 may include various input components, such as one or more of a variety of touch-type controls, electrical, mechanical or electro-mechanical input devices including rotary dials, push buttons, and touch pads. The user interface 112 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that are part of an oven such as e.g., range appliances.

Figure 2:
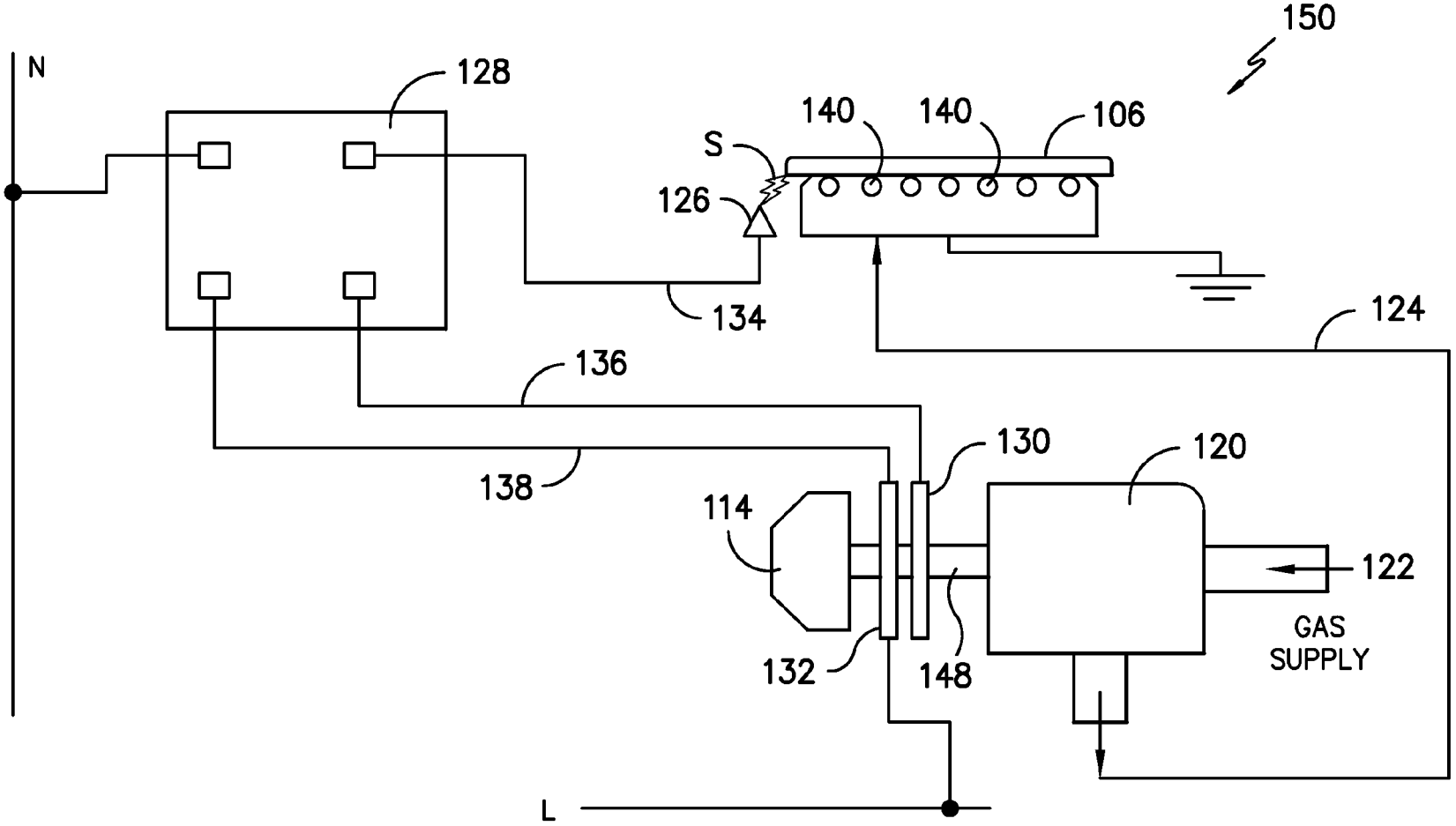
FIG. 2 is a schematic view of a burner ignition system for a cooktop appliance.

FIG. 2 provides a schematic illustration of a burner ignition system 150 as may be used with cooktop appliance 100. System 150 is described with reference to burner 106 by way of example and may be employed with multiple burners. A gas supply 122 is controlled by valve 120 connected with knob 114 by a shaft 148. By rotating knob 114, the user can adjust the position of valve 120 and, therefore, the rate of flow of gaseous fuel to burner 106 by line 124. Fuel as used herein is understood to include both a combustible gas and combustible gas and air mixtures. Fuel is emitted through openings 140 around burner 106. Sparks S from igniter 126 are used to ignite or light such fuel. Valve 120 may be continuously variable meaning that the flow of gas may be varied from 0 to 100 percent through rotation of knob 114. Alternatively, valve 120 may have fixed positions such as an off position where no gas flows to burner 106, a maximum or high position where the valve 120 allows a maximum flow to burner 106, and intermediate positions between off and maximum flow.

A module or controller 128 is in communication with, or connected with, igniter 126 as represented by line 134. Controller 128 can cause igniter 126 to provide sparks S to light burner 106. In addition, igniter 126 is configured to provide a signal to controller 128 indicating when a flame is detected at burner 106 so that sparking can cease. Thus, for this exemplary embodiment, igniter 126 serves a dual purpose of providing ignition of the gaseous fuel while also providing a signal confirming the presence of a flame. In other embodiments of the invention, a separate sensor in communication with controller 128 may be used to detect the presence of a flame at burner 106. Other configurations may be used as well.

Similarly, controller 128 is also in communication with sensors 130 and 132 at valve 120 as represented by lines 136 and 138, respectively. By way of example, sensors 130 and 132 may be configured as switches whereupon rotating knob 114, switch 130 provides electrical power from line L to controller 128 and switch 130 provides a signal indicating the position of knob 114 or, more importantly, the position of valve 120 based upon the rotational position of shaft 148. As such, controller 128 can use sensor 132 to "know" or monitor the rate of gaseous fuel that is being supplied to burner 106.

Using the teachings disclosed herein, it will be understood by one of skill in the art that other configurations can be used whereby controller 128 can monitor the rate of flow of gaseous fuel. For example, a flow rate sensor could be placed in line 124 or line 122. Other configurations could be used as well.

FIG. 3 sets forth an exemplary method 250 of operation of system 150 with appliance 100. At step 200, a user rotates knob 114 (and, therefore, shaft 148) from an off position to open valve 120. As indicated in step 202, this initiates operation of burner 106 by supplying a gaseous fuel through line 124 from supply 112. Igniter 126 provides one or more sparks S until the burner 106 is ignited.

In step 204, controller 128 monitors the rate of flow of gaseous fuel to burner 106. In one embodiment, controller 128 may be programmed to monitor the flow rate of gas continuously. In another exemplary embodiment, controller 128 may be programmed to monitor the flow rate of gas intermittently. In still another exemplary embodiment, controller 128 may be programed to measure the rate of flow of gaseous fuel only when valve 120 is adjusted e.g., only when shaft 148 is rotated to a new position. Other configurations and monitoring schemes may also be used.

Based on the rate of flow of gaseous fuel, in step 206 controller 128 determines or calculates a time interval, $\Delta t_d$, that will be allowed to elapse without detection of a flame before operating igniter 126 to reignite burner 106. More specifically, $\Delta t_d$ is a time interval used to prevent nuisance sparking that would otherwise occur due to the momentary detection of flame absence as may occur due to e.g., wafting other conditions. As stated, it is desirable to avoid sparking and the associated noise when the flame is not actually extinguished and may restore itself without sparking from igniter 126.

A variety of algorithms can be used for computing the magnitude of $\Delta t_d$. In one exemplary embodiment of the invention, $\Delta t_d$ is inversely proportional to the rate of flow of gaseous fuel to burner 106. For example, as valve 120 is opened to increase the rate of gas flow, the magnitude of $\Delta t_d$ is decreased; as valve 120 is closed to decrease the rate of gas flow, the magnitude of $\Delta t_d$ is increased. Wafting and other factors leading to a false detection of the flame being absent from burner 106 are more likely at lower gaseous flow rates where knob 114 has been used to place burner 106 at a low setting. As such, using a longer $\Delta t_d$ at lower flow rates of gaseous fuel is less likely to cause nuisance sparking—i.e. sparking that is unnecessary because the flame will eventually restore itself completely around burner 106. Also, at lower flow rates there is less concern for allowing excessive unignited fuel to flow from burner 106. Conversely, at higher flow rates, the detection of an absent flame is more likely to be accurate and thus a shorter $\Delta t_d$ can used. For example, when burner 106 is set to a minimum flow rate of gaseous fuel, time period $\Delta t_d$ may be less than about three seconds. In another embodiment, when burner 106 is set to a maximum flow rate of gaseous fuel, time period $\Delta t_d$ may be about zero.

Still other algorithms may be used for determining $\Delta t_d$ as well. For example, where valve 120 has e.g., fixed settings of off, low, medium, and high, controller 128 may be programmed with a fixed value for $\Delta t_d$ at each such setting. In one exemplary embodiment, a $\Delta t_d$ might be about zero or less than about one second at a high setting, about two seconds at the medium setting, and about three seconds or more at the low setting. A variety of other values and control algorithms may be used as well.

In step 208, controller 128 detects whether a flame is present at burner 106 as previously described using, for this embodiment, igniter 128. If a flame is detected at burner 106, controller 128 simply continues to monitor the flow rate of gaseous fuel. If, however, controller 128 detects that a flame is absent from burner 106, then in step 210 controller 128 initiates a timer to allow a time period $\Delta t_d$ to elapse.

If the flame is detected at burner 106 before time period $\Delta t_d$ has elapsed, then controller 128 resets the timer and returns to step 204 to monitor the flow rate of gaseous fuel. If a flame is not detected after the elapse of $\Delta t_d$, then in step 212 the controller 128 activates igniter 126 until such flame is detected, resets the timer, and returns to step 204.

FIG. 3 is provided by way of example only. Other methods and steps of using a delay $\Delta t_d$ to prevent nuisance sparking where $\Delta t_d$ has a magnitude based upon the rate of gas flow the burner may be used as well. In addition, while the above example was described with burner 106, controller 128 could be configured to provide a similar control function at the same time for each burner of appliance 100 as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a burner assembly of a cooktop appliance, comprising the steps of:

supplying gaseous fuel to a burner of the burner assembly;

monitoring a rate of flow of gaseous fuel to the burner;

determining a time period $\Delta t_d$ that is based upon the rate of flow of gaseous fuel to the burner;

detecting whether a flame is present at the burner and, if not, then activating a spark igniter for the burner after a time period $\Delta t_d$ has elapsed during which no flame is detected at the burner;

wherein the magnitude of time period $\Delta t_d$ is inversely proportional to the rate of flow of gaseous fuel to the burner.

2. The method for operating a burner assembly of a cooktop appliance as in claim 1, wherein the magnitude of time period $\Delta t_d$ is increased as the rate of flow of gaseous fuel is decreased.

3. The method for operating a burner assembly of a cooktop appliance as in claim 2, wherein the magnitude of time period $\Delta t_d$ is decreased as the rate of flow of gaseous fuel is increased.

4. A method for operating a burner assembly of a cooktop appliance as in claim 1, wherein the cooktop appliance includes a valve for controlling the flow of gaseous fuel to the burner, the valve having settings that include off, one or more intermediate positions, and maximum, and wherein time period $\Delta t_d$ is about zero if the valve is set at the maximum for the rate of flow of gaseous fuel.

5. A method for operating a burner assembly of a cooktop appliance as in claim 1, wherein the cooktop appliance includes a valve for controlling the flow of gaseous fuel to the burner, the valve having settings that include off, one or more intermediate positions, and maximum, and wherein time period $\Delta t_d$ is less than about 1 second if the switch is set at the maximum for the rate of flow of gaseous fuel.

6. A method for operating a burner assembly of a cooktop appliance as in claim 1, wherein the cooktop appliance includes a valve that is continuously variable for controlling the rate of flow of gaseous fuel to the burner.

7. A method for operating a burner assembly of a cooktop appliance as in claim 6, wherein the magnitude of time period $\Delta t_d$ is inversely proportional to the rate of flow of gaseous fuel to the burner.

8. An appliance with a cooktop, comprising:

a gas burner positioned on the cooktop;

a valve controlling a flow of gaseous fuel to the burner;

a sensor configured to measure and signal a rate of flow of gaseous fuel to the gas burner;

a spark igniter positioned near the gas burner and configured for igniting the gaseous fuel and detect a flame;

a controller configured to monitor signals from the sensor indicating the rate of flow of gaseous fuel;

calculate a time period $\Delta t_d$ based on the rate of flow of gaseous fuel to the burner;

detect whether a flame is present at the burner and, if not, then activate the spark igniter after a time period $\Delta t_d$ has elapsed during which no flame is detected at the burner;

wherein the magnitude of time period $\Delta t_d$ is inversely proportional to the rate of flow of gaseous fuel to the burner.

9. The appliance with a cooktop as in claim 8, wherein the magnitude of time period $\Delta t_d$ is increased as the rate of flow of gaseous fuel is decreased.

10. The appliance with a cooktop as in claim 8, wherein the magnitude of time period $\Delta t_d$ is decreased as the rate of flow of gaseous fuel is increased.

11. The appliance with a cooktop as in claim 8, wherein the valve is configured with fixed settings that include off, one or more intermediate positions, and maximum flow, and wherein time period $\Delta t_d$ is about zero if the valve is set at the maximum flow for the rate of flow of gaseous fuel.

12. The appliance with a cooktop as in claim 8, wherein the valve is configured with settings that include off, one or more intermediate positions, and maximum flow, and wherein time period $\Delta t_d$ is less than about 1 second if the switch is set at the maximum flow for the rate of flow of gaseous fuel.

13. The appliance with a cooktop as in claim 8, wherein the cooktop appliance includes a valve that is continuously variable for controlling the rate of flow of gaseous fuel to the burner.

14. The appliance with a cooktop as in claim 13, wherein the magnitude of time period $\Delta t_d$ is inversely proportional to the rate of flow of gaseous fuel to the burner.

15. The appliance with a cooktop as in claim 8, wherein the valve further comprises a rotatable shaft that is configured to control the rate of flow of gaseous fuel through the valve based on the rotational position of the shaft.

16. The appliance with a cooktop as in claim 15, wherein the sensor is configured to determine the rotational position of the shaft so as to measure the rate of flow of gaseous fuel.

* * * * *